United States Patent [19]

Humbach et al.

[11] Patent Number: 4,661,238

[45] Date of Patent: Apr. 28, 1987

[54] COMBINATION PROCESS FOR THE CONVERSION OF A DISTILLATE HYDROCARBON TO MAXIMIZE MIDDLE DISTILLATE PRODUCTION

[75] Inventors: Michael J. Humbach, Wilmette, Ill.; John G. Hale, Egham, United Kingdom

[73] Assignee: UOP Inc., Des Plaines, Ill.

[21] Appl. No.: 772,795

[22] Filed: Sep. 5, 1985

[51] Int. Cl.[4] ..... C10G 65/12; C10G 69/04

[52] U.S. Cl. ..... 208/61; 208/58; 208/49

[58] Field of Search ..... 208/61, 60, 58, 82, 208/52 R

[56] References Cited

U.S. PATENT DOCUMENTS

| | | | |
|---|---|---|---|
| 3,071,536 | 1/1963 | Stiles et al. | 208/61 |
| 3,594,309 | 7/1971 | Stolfa | 208/89 |
| 3,730,875 | 5/1973 | Gleim et al. | 208/57 |
| 3,751,360 | 8/1973 | Bernstein et al. | 208/61 |
| 3,775,293 | 11/1973 | Watkins | 208/86 |
| 3,898,299 | 8/1975 | Jones | 208/61 |
| 3,944,481 | 3/1976 | Wing et al. | 208/61 |
| 3,984,305 | 10/1976 | Hosoi et al. | 208/61 |
| 4,039,429 | 8/1977 | Klinken et al. | 208/61 |
| 4,137,147 | 1/1979 | Franck et al. | 208/61 |
| 4,181,601 | 1/1980 | Sze | 208/143 |
| 4,216,077 | 8/1980 | Chahuekiliun et al. | 208/61 |
| 4,324,935 | 4/1982 | Wernicke et al. | 585/314 |
| 4,500,416 | 2/1985 | Dongen et al. | 208/61 |

*Primary Examiner*—Andrew H. Metz
*Assistant Examiner*—Chung K. Pak
*Attorney, Agent, or Firm*—Thomas K. McBride; John F. Spears, Jr.; John G. Cutts

[57] ABSTRACT

A process for the conversion of an aromatic-rich, distillable gas oil charge stock to selectively produce large quantities of high quality middle distillate while minimizing hydrogen consumption which process comprises the steps of reacting the charge stock with hydrogen, in a catalytic hydrocracking reaction zone, at hydrocracking conditions including a maximum catalyst bed temperature in the range of about 600° F. (315° C.) to about 850° F. (454° C.) selected to convert at least a portion of the charge stock to lower-boiling hydrocarbon products including middle distillate and to convert at least about 10 volume percent of the aromatic hydrocarbon compounds contained in the charge stock to provide an increased concentration of paraffin hydrocarbon compounds in the resulting hydrocracking reaction zone effluent; separating the resulting hydrocracking reaction zone effluent to provide a middle distillate product stream and a paraffin-rich hydrocarbonaceous stream boiling at a temperature greater than about 700° F. (371° C.); recovering the middle distillate product stream; reacting the paraffin-rich hydrocarbonaceous stream recovered above in a non-catalytic thermal reaction zone at mild thermal cracking conditions including an elevated temperature from about 700° F. (371° C.) to about 980° F. (526° C.), a pressure from about 30 psig (207 k Pa gage) to about 1000 psig (6895 k Pa gage) and an equivalent residence time at 900° F. (482° C.) from about 1 to about 60 seconds to provide a non-catalytic thermal reaction zone effluent; and separating the non-catalytic thermal reaction zone effluent to provide a fraction boiling in the range from about 300° F. (149° C.) to about 700° F. (371° C.).

15 Claims, 2 Drawing Figures

COMBINATION PROCESS FOR THE CONVERSION OF A DISTILLATE HYDROCARBON TO MAXIMIZE MIDDLE DISTILLATE PRODUCTION

BACKGROUND OF THE INVENTION

The field of art to which this invention pertains is the maximization of middle distillate from heavy distillate hydrocarbon. More specifically, the invention relates to a process for the conversion of an aromatic-rich, distillable gas oil charge stock to selectively produce large quantities of high quality middle distillate while minimizing hydrogen consumption which process comprises the steps of reacting the charge stock with hydrogen, in a catalytic hydrocracking reaction zone, at hydrocracking conditions including a maximum catalyst bed temperature in the range of about 600° F. (315° C.) to about 850° F. (454° C.) selected to convert at least a portion of the charge stock to lower-boiling hydrocarbon products including middle distillate and to convert at least about 10 volume percent of the aromatic hydrocarbon compounds contained in the charge stock to provide an increased concentration of paraffin hydrocarbon compounds in the resulting hydrocracking reaction zone effluent; separating the resulting hydrocracking reaction zone effluent to provide a middle distillate product stream and a paraffin-rich hydrocarbonaceous stream boiling at a temperature greater than about 700° F. (371° C.); recovering the middle distillate product stream; reacting the paraffin-rich hydrocarbonaceous stream recovered above in a non-catalytic thermal reaction zone at mild thermal cracking conditions including an elevated temperature from about 700° F. (371° C.) to about 980° F. (526° C.), a pressure from about 30 psig (207k Pa gage) to about 1000 psig (6895k Pa gage) and an equivalent residence time at 900° F. (482° C.) from about 1 to about 60 seconds to provide a non-catalytic thermal reaction zone effluent; and separating the non-catalytic thermal reaction zone effluent to provide a fraction boiling in the range of about 300° F. (149° C.) to about 700° F. (371° C.).

INFORMATION DISCLOSURE

In U.S. Pat. No. 3,730,875 (Gleim et al.), a process is disclosed for the conversion of an asphaltene-containing hydrocarbonaceous charge stock into lower-boiling hydrocarbon products which comprises (a) reacting said charge stock with hydrogen in a catalytic hydrogenation reaction zone; (b) further reacting the resulting hydrogenated effluent, in a non-catalytic thermal reaction zone; and (c) reacting at least a portion of the resulting normally liquid, thermally-cracked effluent, in a catalytic hydrocracking reaction zone. U.S. Pat. No. 3,730,875 also teaches that a portion of a hydrocracker effluent may be recycled to the hydrogenation zone.

In U.S. Pat. No. 3,594,309 (Stolfa), a process is disclosed for the conversion of an asphaltene-containing hydrocarbonaceous charge stock into lower-boiling hydrocarbon products which comprise (a) reacting said charge stock with hydrogen in a catalytic reaction zone, (b) cracking at least a portion of the catalytic reaction zone effluent in a non-catalytic reaction zone, and (c) recycling a slop wax stream resulting from the non-catalytic reaction zone to the catalytic reaction zone of step (a). The slop wax stream is characterized as boiling in a temperature range above that of the vacuum gas oils and within a temperature range of about 980° F. (526° C.) to about 1150° F. (620° C.).

In U.S. Pat. No. 3,775,293 (Watkins), a method is disclosed for reacting a hydrocarbonaceous resin with hydrogen, in a catalytic hydrocracking reaction zone, at hydrocracking conditions selected to convert resin into lower-boiling hydrocarbon; further reacting at least a portion of the hydrocracking effluent in a non-catalytic reaction zone, at thermal cracking conditions, and reacting at least a portion of the resulting thermally cracked product effluent in a separate catalytic reaction zone, with hydrogen, at hydrocracking conditions. Hydrocarbonaceous resins are considered to be non-distillable with boiling points greater than about 1050° F. (565° C.).

Furthermore, the hydrogenation of a thermal cracking feedstock is disclosed in U.S. Pat. No. 4,181,601 (Sze) and U.S. Pat. No. 4,324,935 (Wernicke et al.).

BRIEF SUMMARY OF THE INVENTION

The invention provides an integrated process for the conversion of an aromatic-rich, distillable gas oil charge stock to selectively produce large quantities of high quality middle distillate while minimizing hydrogen consumption by reacting the aromatic-rich charge stock in a hydrocracking reaction zone to produce a middle distillate product stream and a paraffin-rich hydrocarbonaceous stream boiling at a temperature greater than about 700° F. This resulting paraffin-rich hydrocarbonaceous stream, which is particularly well suited for a charge stock for a non-catalytic thermal reaction by virtue of its high paraffin concentration, is reacted in a non-catalytic thermal reaction zone at mild thermal cracking conditions to produce another middle distillate product stream.

One embodiment of the invention may be characterized as a process for the conversion of an aromatic-rich, distillable gas oil charge stock to selectively produce large quantities of high quality middle distillate while minimizing hydrogen consumption which process comprises the steps of reacting the charge stock with hydrogen, in a catalytic hydrocracking reaction zone, at hydrocracking conditions including a maximum catalyst bed temperature in the range of about 600° F. (315° C.) to about 850° F. (454° C.) selected to convert at least a portion of the charge stock to lower-boiling hydrocarbon products including middle distillate and to convert at least about 10 volume percent of the aromatic hydrocarbon compounds contained in the charge stock to provide an increased concentration of paraffin hydrocarbon compounds in the resulting hydrocracking reaction zone effluent; separating the resulting hydrocracking reaction zone effluent to provide a middle distillate product stream and a paraffin-rich hydrocarbonaceous stream boiling at a temperature greater than about 700° F. (371° C.); recovering the middle distillate product stream; reacting the paraffin-rich hydrocarbonaceous stream recovered above in a non-catalytic thermal reaction zone at mild thermal cracking conditions including an elevated temperature from about 700° C. (371° C.) to about 980° F. (526° C.), a pressure from about 30 psig (207k Pa gage) to about 1000 psig (6895k Pa gage) and an equivalent residence time at 900° F. (482° C.) from about 1 to about 60 seconds to provide a non-catalytic thermal reaction zone effluent; and separating the non-catalytic thermal reaction zone effluent to provide a fraction boiling in the range from about 300° F. (149° C.) to about 700° F. (371° C.).

Another embodiment of the invention may be characterized as a process for the conversion of an aromatic-rich, distillable gas oil charge stock to selectively produce large quantities of high quality middle distillate while minimizing hydrogen consumption which process comprises the steps of reacting the charge stock with hydrogen, in a catalytic hydrocracking reaction zone, at hydrocracking conditions including a maximum catalyst bed temperature in the range of about 600° F. (315° C.) to about 850° F. (454° C.) selected to convert at least a portion of the charge stock to lower-boiling hydrocarbon products including middle distillate and to convert at least about 10 volume percent of the aromatic hydrocarbon compounds contained in the charge stock to provide an increased concentration of paraffin hydrocarbon compounds in the resulting hydrocracking reaction zone effluent; separating the resulting hydrocracking reaction zone effluent to provide a first middle distillate product stream and a paraffin-rich hydrocarbonaceous stream boiling at a temperature greater than about 700° F. (371° C.); reacting the paraffin-rich hydrocarbonaceous stream recovered above in a non-catalytic thermal reaction zone at mild thermal cracking conditions including an elevated temperature from about 700° F. (371° C.) to about 980° F. (526° C.), a pressure from about 30 psig (207k Pa gage) to about 1000 psig (6895k Pa gage) and an equivalent residence time at 900° F. (482° C.) from about 1 to about 60 seconds; separating the resulting non-catalytic thermal reaction zone effluent to provide a second middle distillate product stream and a hydrocarbonaceous stream boiling at a temperature greater than about 700° F. (371° C.); and recovering the first and second middle distillate product streams.

Yet another embodiment of the invention may be characterized as a process for the conversion of an aromatic-rich, distillable gas oil charge stock to selectively produce large quantities of high quality middle distillate while minimizing hydrogen consumption which process comprises the steps of reacting the charge stock with hydrogen, in a catalytic hydrocracking reaction zone, at hydrocracking conditions including a maximum catalyst bed temperature in the range of about 600° F. (315° C.) to about 850° F. (454° C.) selected to convert at least a portion of the charge stock to lower-boiling hydrocarbon products including middle distillate and to convert at least about 10 volume percent of the aromatic hydrocarbon compounds contained in the charge stock to provide an increased concentration of paraffin hydrocarbon compounds in the resulting hydrocracking reaction zone effluent; separating the resulting hydrocracking reaction zone effluent to provide a first middle distillate product stream and a paraffin-rich hydrocarbonaceus stream boiling at a temperature greater than about 700° F. (371° C.); recovering the middle distillate product stream; reacting the paraffin-rich hydrocarbonaceous stream recovered above in a non-catalytic thermal reaction zone at mild thermal cracking conditions including an elevated temperature from about 700° F. (371° C.) to about 980° F. (526° C.), a pressure from about 30 psig (207k Pa gage) to about 1000 psig (6895k Pa gage) and an equivalent residence time at 900° F. (482° C.) from about 1 to about 60 seconds to provide a non-catalytic thermal reaction zone effluent; separating the non-catalytic thermal reaction zone effluent to provide a fraction boiling in the range from about 300° F. (149° C.) to about 700° F. (371° C.) and a hydrocarbonaceous stream boiling at a temperature greater than about 700° F. (371° C.); and reacting at least a portion of the hydrocarbonaceous stream boiling at a temperature greater than about 700° F. (371° C.) recovered above in a fluid catalytic cracking zone at fluid catalytic cracking conditions.

Other embodiments of the present invention encompass further details such as feedstock, hydrocracking and fluid catalytic cracking catalysts, and operating conditions, all of which are hereinafter disclosed in the following discussion of each of these facets of the invention.

DETAILED DESCRIPTION OF THE INVENTION

Figure 1:
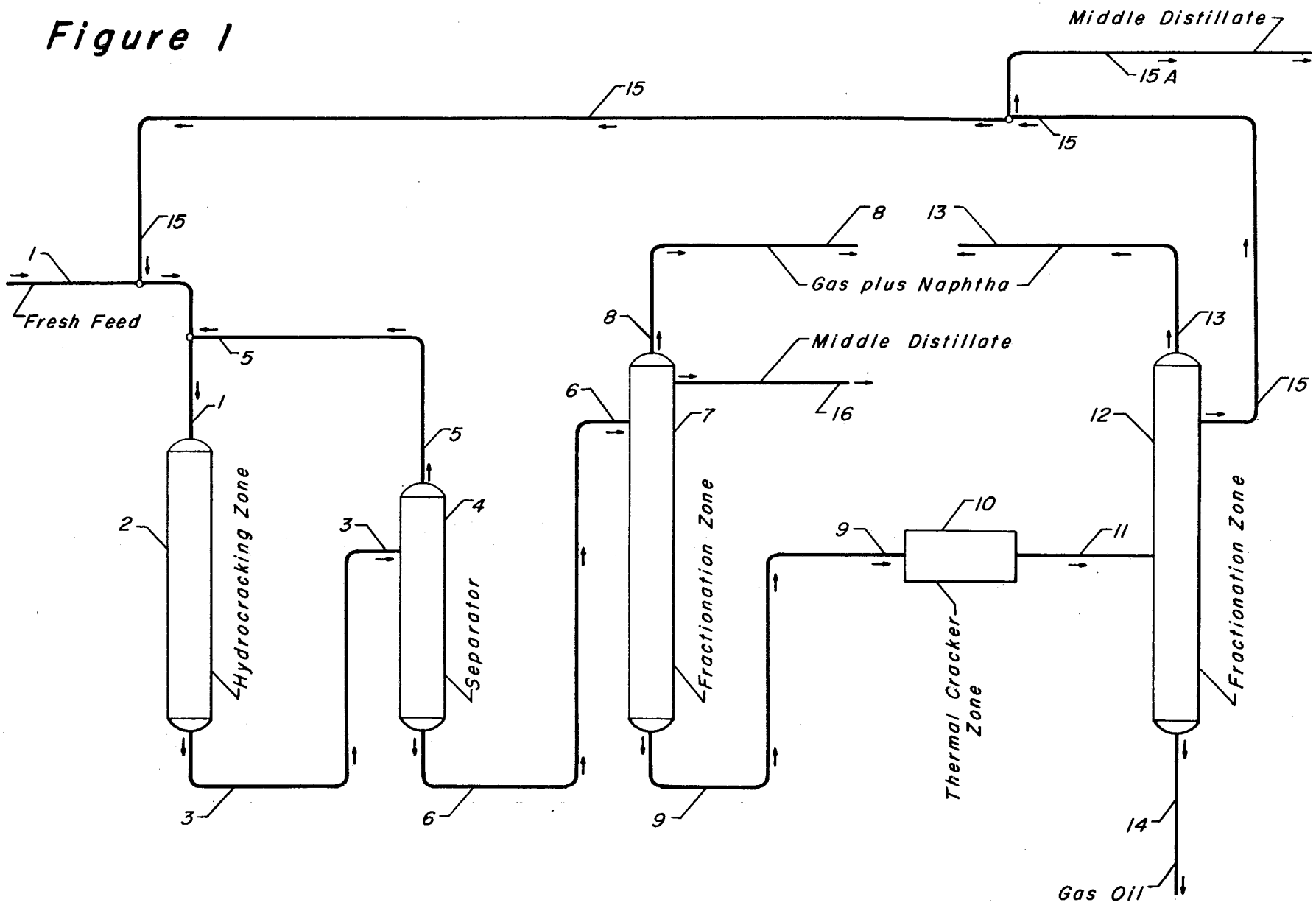
FIG. 1 and FIG. 2 are simplified process flow diagrams of preferred embodiments of the present invention.

There is a steadily increasing demand for high quality middle distillate products boiling in the range of about 300° F. (149° C.)–700° F. (371° C.). Such products include for example aviation turbine fuels, diesel fuels, heating oils, solvents and the like. In order to satisfy the demand for these products, a plethora of catalytic hydrocracking processes have been developed. However, catalytic hydrocracking has been previously aimed primarily at the production of lower boiling products such as gasoline and highly active catalysts have been developed for that purpose. These catalysts usually comprise a highly acidic cracking base such as hydrogen Y zeolite or silica-alumina cogel, upon which is deposited a suitable hydrogenation metal component. By utilizing these earlier catalysts and hydrocracking processes for the conversion of heavy oils boiling above about 700° F. (371° C.) to middle distillate products, the selectivity to middle distillate was much less than desirable. Under hydrocracking conditions which were severe enough to give economical conversion of the feedstock, a large proportion of the feedstock was converted to products boiling below about 400° F. (204° C.) thereby reducing the yield of middle distillate product. Enhanced yield of middle distillate product could be achieved however with improved middle distillate hydrocracking catalysts, but this method of conventional hydrocracking is expensive and in many instances uneconomical. For example, with a conventional hydrocracking process producing equivalent overall middle distillate yields relative to the process of the present invention, the advantages enjoyed by the present invention are (1) lower capital cost, (2) lower hydrogen consumption and (3) minimal loss of middle distillate in spite of the significantly lower hydrogen consumption.

The contemporary technology, as acknowledged hereinabove, teaches that asphaltene-containing hydrocarbonaceous charge stock and non-distillable hydrocarbonaceous charge stock boiling at a temperature greater than about 1050° F. (565° C.) may be charged to a hydrogenation or hydrocracking reaction zone and that at least a portion of the effluent from the hydrogenation or hydrocracking reaction zone may be charged to a non-catalytic thermal reaction zone. This technology has broadly taught the production of lower boiling hydrocarbons. However, the present technology has not recognized that large quantities of high quality middle distillate may be produced with minimal hydrogen consumption by the conversion of an aromatic rich, distillable gas oil charge stock in an integrated process.

With an increased demand for middle distillate product from heavy hydrocarbonaceous feedstock, more economical and selective processes for the conversion of heavy hydrocarbons have been sought. We have discovered, quite surprisingly, an integrated process which is highly selective towards the production of middle distillate with a charge stock of an aromatic-rich, distillable gas oil. The integrated process of the present invention has lower capital costs, improved selectivity to middle distillate product and reduced hydrogen consumption when compared with processes of the prior art.

The present invention provides an improved integrated process utilizing mild hydrocracking and thermal cracking to produce significant quantities of middle distillate with low hydrogen consumption while simultaneously minimizing large yields of normally gaseous hydrocarbons, naphtha and thermal tar. For purposes of the subject invention the term middle distillate product generally refers to a hydrocarbonaceous product which boils in the range of about 300° F. (149° C.) to about 700° F. (371° C.). The term mild hydrocracking is used to describe hydrocracking which is conducted at operating conditions which are generally less severe than those conditions used in conventional hydrocracking.

The hydrocarbon charge stock subject to processing in accordance with the process of the present invention is suitably an aromatic-rich, distillable petroleum fraction boiling in the range from about 700° F. (371° C.) to about 1100° F. (593° C.). For purposes of the present invention, the aromatic-rich, distillable hydrocarbon charge stock is essentially free from asphaltenic hydrocarbons. A preferred hydrocarbon charge stock boils in the range from about 700° F. (371° C.) to about 1050° F. (565° C.) and has an aromatic hydrocarbon compound concentration greater than about 20 volume percent. Petroleum hydrocarbon fractions which may be utilized as charged stocks thus include the heavy atmospheric and vacuum gas oils recovered as distillate in the atmospheric and vacuum distillation of crude oils. Also, heavy cycle oils recovered from the catalytic cracking process, and heavy coker gas oils resulting from low pressure coking may also be used as charge stocks. The hydrocarbon charge stock may boil substantially continuously between about 700° F. (371° C.) to about 1100° F. (593° C.) or it may consist of any one, or a number of petroleum hydrocarbon fractions, which distill over within the 700° F. (371° C.) to 1100° F. (593° C.) range. Suitable hydrocarbon charge stocks also include hydrocarbons derived from tar sand, oil shale and coal. Hydrocarbonaceous compounds boiling in the range from about 700° F. (371° C.) to about 1100° F. (593° C.) are herein referred to as gas oil. Although gas oils having an aromatic hydrocarbon compound concentration less than about 20 volume percent may be charged to the process of the subject invention, all of the herein described advantages will not necessarily be fully enjoyed.

In the hydrocarbon processing art, an indicia of a hydrocarbon's characteristics has become well known and almost universally accepted and is referred to as the "UOP Characterization Factor" or "K". This UOP Characterization Factor is indicative of the general origin and nature of a hydrocarbon feedstock. "K" values of 12.5 or higher indicate a hydrocarbon material which is predominantly paraffinic in nature. Highly aromatic hydrocarbons have characterization factors of about 10.0 or less. The "UOP Characterization Factor", K, of a hydrocarbon is defined as the cube root of its absolute boiling point, in degrees Rankine, divided by its specific gravity at 60° F. Further information relating to the use of the UOP Characterization Factor may be found in a book entitled *The Chemistry and Technology of Petroleum*, published by Marcel Dekker, Inc., New York and Basel in 1980 at pages 46–47.

Preferred hydrocarbon feedstocks for use in the present invention preferably possess a UOP Characterization Factor, as hereinabove described, of less than about 12.4 and more preferably of less than about 12.0. Although feedstocks having a higher UOP Characterization Factor may be utilized as feedstock in the present invention, the use of such a feedstock may not necessarily enjoy all of the herein described benefits including the selective conversion to middle distillate product.

During the practice of the present invention while utilizing the hereinabove described preferred hydrocarbonaceous feedstocks, it is contemplated that relatively small quantities of other potentially available hydrocarbonaceous material, such as, for example, deasphalted oil and demetalized oil may be introduced into the process of the present invention as a commercial expediency. Although such hydrocarbonaceous materials are not preferred hydrocarbonaceous feedstocks of the present invention, those skilled in the art of hydrocarbon processing may find that the introduction of small quantities along with the preferred hydrocarbonaceous feedstock would not be unduly harmful and that some benefit may be enjoyed.

In accordance with the present invention an aromatic-rich, distillable gas oil charge stock is admixed with a recycled hydrogen-rich gaseous phase, make-up hydrogen and an optional recycled hydrocarbonaceous stream boiling in the range of about 300° F. (149° C.) to about 700° F. (371° C.) and introduced into a catalytic hydrocracking reaction zone. This reaction zone is preferably maintained under an imposed pressure of from about 500 psig (3447k Pa gage) to about 3000 psig (20685k Pa gage) and more preferably under a pressure from about 600 psig (4137k Pa gage) to about 1600 psig (11032k Pa gage). Suitably, such reaction is conducted with a maximum catalyst bed temperature in the range of about 600° F. (315° C.) to about 850° F. (454° C.) selected to convert at least a portion of the fresh feedstock to lower-boiling hydrocarbon products and to convert at least about 10 volume percent of the aromatic hydrocarbon compounds contained in the charge stock to provide an increased concentration of paraffin hydrocarbon compounds in the resulting hydrocracking reaction zone effluent. In a preferred embodiment, the maximum catalyst bed temperature is selected to convert less than about 50 volume percent of the fresh charge stock to lower-boiling hydrocarbon products and to consume less than about 900 SCFB (160 std. $m^3/m^3$) of hydrogen based on fresh charge stock. Further operating conditions include liquid hourly space velocities in the range from about 0.2 $hour^{-1}$ to about 10 $hour^{-1}$ and hydrogen circulation rates from about 500 SCFB (88.9 std $m^3/m^3$) to about 10,000 SCFB (1778 std $m^3/m^3$), preferably from about 800 SCFB (142 std $m^3/m^3$) to about 5,000 SCFB (889 std $m^3/m^3$), while the combined feed ratio, defined as total volumes of liquid charge per volume of fresh hydrocarbon charge, is in the range from about 1:1 to about 3:1.

The catalytic composite disposed within the hydrocracking reaction zone can be characterized as containing a metallic component having hydrogenation activity, which component is combined with a suitable refractory inorganic oxide carrier material of either synthetic of natural origin. The precise composition and method of manufacturing the carrier material is not considered essential to the present invention. Preferred carrier material may for example comprise 100 weight percent alumina, 88 weight percent alumina and 12 weight percent silica, or 63 weight percent of alumina and 37 weight percent silica, or 68 weight percent alumina, 10 weight percent silica and 22 weight percent boron phosphate. Suitable metallic components having hydrogenation activity are those selected from the group consisting of the metals of Groups VI-B and VIII of the Periodic Table, as set forth in the Periodic Table of the Elements, E. H. Sargent & Company, 1964. Thus, the catalytic composites may comprise one or more metallic components from the group of molybdenum, tungsten, chromium, iron, cobalt, nickel, platinum, iridium, osmium, rhodium, ruthenium, and mixtures thereof. In addition, phosphorus is a suitable component of the catalytic composite which may be disposed within the hydrocracking reaction zone. The concentration of the catalytically active metallic component, or components, is primarily dependent upon a particular metal as well as the physical and/or chemical characteristics of the particular charge stock. For example, the metallic components of Group VI-B are generally present in an amount within the range of from 1 to about 20 weight percent, the iron-group metals in an amount within the range of about 0.2 to about 10 weight percent, whereas the noble metals of Group VIII are preferably present in an amount within the range of from about 0.1 to about 5 weight percent, all of which are calculated as if these components existed within the catalytic composite in the elemental state.

The resulting hydrocarbonaceous hydrocracking reaction zone effluent is separated to provide a paraffin-rich hydrocarbonaceous stream boiling at a temperature greater than about 700° C. (371° C.). Additionally, the resulting hydrocarbonaceous hydrocracking reaction zone effluent provides a middle distillate product stream which boils in the range of about 300° F. (149° C.) to about 700° F. (371° C.). The resulting paraffin-rich hydrocarbonaceous stream boiling at a temperature greater than about 700° F. (371° C.) is reacted in a non-catalytic thermal reaction zone at thermal cracking conditions including an elevated temperature in the range of about 700° F. (371° C.) to about 980° F. (526° C.), a pressure from about 30 psig (207k Pa gage) to about 1000 psig (6895k Pa gage) and an equivalent residence time at 900° F. (482° C.) from about 1 to about 60 seconds and more preferably from about 1 to about 30 seconds. More preferably, the non-catalytic thermal reaction zone is conducted at a pressure from about 30 psig (207k Pa gage) to about 500 psig (3447k Pa gage).

Although the residence time in the non-catalytic thermal cracker is specified as an equivalent time at 900° F. (482° C.), the actual operating temperature of the thermal cracker may be selected from a temperature in the range of about 700° F. (371° C.) to about 980° F. (526° C.). The conversion of the thermal cracker charge stock proceeds via a time-temperature relationship. Thus, for a given charge stock and a particular desired conversion level, a certain residence time at some elevated temperature is required. For the sake of a standard reference, the residence time, as described herein, is referred to as equivalent residence time at 900° F. (482° C.). For a thermal cracker temperature other than 900° F. (482° C.), the corresponding residence time can be determined using the equivalent time at 900° F. and the Arrhenius equation.

The Arrhenius equation is represented as $$K = Ae^{-E/RT}$$

where

K is the reaction rate constant

E is the activation energy

A is the frequency factor and

T is the temperature

The reaction rate $(-r)$ is proportional to the reaction rate constant (k) and time (t) and this relationship is represented by $$-r = kt.$$

In accordance with the present invention, the non-catalytic thermal cracker is preferably operated at a relatively low severity in order to produce a maximum yield of hydrocarbonaceous products in the middle distillate boiling range. Therefore, the thermal cracker is preferably operated with an equivalent residence time at 900° F. (482° C.) from about 1 to about 60 seconds and more preferably from about 1 to about 30 seconds. The resulting effluent from the non-catalytic thermal reaction zone is preferably separated to provide a hydrocarbon stream boiling at less than about 300° F. (149° C.) comprising normally gaseous hydrocarbons and naphtha, a middle distillate hydrocarbon stream boiling in the range of about 300° F. (149° C.) to about 700° F. (371° C.) which may optionally be recycled to the hydrocracking reaction zone in admixture with the fresh feed and a hydrogen-rich gas, and a heavy hydrocarbonaceous product stream boiling in the range above that of middle distillate, viz., greater than about 700° F. (371° C.). Separation of the effluents from the thermal reaction zone and the hydrocracking zone may be performed by any suitable and convenient means known to those skilled in the art. Such separation is preferably conducted in one or more fractional distillation columns, flash separators or combinations thereof.

In another embodiment of the present invention, the resulting heavy hydrocarbonaceous stream boiling in the range above that of middle distillate from the non-catalytic thermal reaction zone is charged to a fluid catalytic cracking zone at fluid catalytic cracking conditions. Fluidized catalytic cracking processes are in widespread commercial use in petroleum refineries. They are utilized to reduce the average molecular weight of various hydrocarbon feed streams to yield higher value products. Operating conditions which may be utilized in the fluid catalytic cracking zone include a reactor temperature from about 900° F. (482° C.) to about 1350° F. (734° C.), a pressure from about 0 (101k Pa gage) to about 200 psig (1379k Pa gage), and a catalyst to oil ratio, based on the weight of catalyst and feed hydrocarbon, of up to about 50:1. The type of catalyst which may be employed in the fluid catalytic cracking zone is chosen from a variety of commercially available catalysts. A catalyst comprising a zeolitic base material is preferred but the older style amorphous catalyst can be used if desired. In the event that a fluid catalytic cracking zone is utilized in an embodiment of the present invention, it is preferred that elemental hydrogen is not added to the fluid catalytic cracking zone for purposes of reaction with the hydrocarbonaceous charge thereto. The resulting effluent from the fluid catalytic cracking zone is preferably separated to provide a hydrocarbon stream boiling at less than about 300° F. (149° C.) comprising normally gaseous hydrocarbons and naphtha, a light cycle oil (LCO) stream boiling in the range of about 400° F. (204° C.) to about 650° F. (343° C.) and a clarified oil stream boiling above that of light cycle oil. Separation of the effluent from the fluid catalytic cracking zone may be performed by any suitable and convenient means known to those skilled in the art and is preferably conducted in one or more fractional distillation columns.

In FIG. 1, one embodiment of the subject invention is illustrated by means of a simplified flow diagram in which such details as pumps, instrumentation, heat-exchange and heat-recovery circuits, compressors and similar hardware have been deleted as being non-essential to an understanding of the techniques involved. The use of such miscellaneous appurtenances are well within the purview of one skilled in the art of petroleum refining techniques. With reference now to FIG. 1, an aromatic-rich, distillable gas oil feedstock is introduced into the process via conduit 1, being admixed therein with a gaseous hydrogen-rich recycle stream which is provided via conduit 5 and a hereinafter described hydrocarbonaceous recycle stream provided via conduit 15. Following suitable heat-exchange, the admixture continues through conduit 1 into hydrocracking zone 2 which contains a fixed-bed of a catalytic composite of the type hereinabove described.

The principal function of hydrocracking zone 2 resides in the maximum production of middle distillate while minimizing the production of hydrocarbons boiling in the range below about 300° F. (149° C.) and in the conversion of aromatic hydrocarbon compounds contained in the charge stock to provide an increased concentration of paraffin hydrocarbon compounds. The peak temperature of the catalyst is adjusted to effect the desired yield pattern and aromatic hydrocarbon compound conversion. The effluent from hydrocracking zone 2 is cooled and passes via conduit 3 into separator 4. A hydrogen-rich gaseous stream is removed from separator 4 via conduit 5 and recycled to hydrocracking zone 2 via conduits 5 and 1. Since hydrogen is consumed within the hydrocracking process, it is necessary to supplant the consumed hydrogen with make-up hydrogen from some suitable external source, i.e., a catalytic reforming unit or a hydrogen plant. Make-up hydrogen may be introduced into the system at any suitable point. The normally liquid hydrocarbons are removed from separator 4 via conduit 6 and introduced into fractionation zone 7. A middle distillate hydrocarbonaceous product is removed from fractionation zone 7 via conduit 16 and a paraffin-rich hydrocarbonaceous stream boiling in a range above the middle distillate boiling range is removed from fractionation zone 7 via conduit 9. A light hydrocarbonaceous product stream boiling at a temperature less than about 350° F. (177° C.) is removed from fractionation zone 7 via conduit 8. The paraffin-rich hydrocarbonaceous stream boiling in a range above that of middle distillate is introduced via conduit 9 into thermal cracker zone 10, wherein the hydrocarbonaceous stream is subjected to thermal cracking conditions including an elevated temperature in the range of about 700° F. (371° C.) to about 980° F. (526° C.) and an equivalent residence time at 900° F. (482° C.) from about 1 to about 60 seconds. The thermal cracking product effluent is withdrawn from thermal cracker zone 10 via conduit 11 and introduced into fractionation zone 12. A hydrocarbonaceous stream boiling in the range from about 350° F. (177° C.) to about 700° F. (371° C.) is withdrawn from fractionation zone 12 via conduit 15 and at least a portion is introduced into hydrocracking zone 2 via conduits 15 and 1 as the hereinabove mentioned hydrocarbonaceous recycle stream. A hydrocarbonaceous product stream boiling in the range from about 350° F. (177° C.) to about 700° F. (371° C.) may also be produced in fractionation zone 12 and is recovered via conduits 15 and 15A. Such a product stream will necessarily be olefinic in nature and may require further processing. A light hydrocarbon stream boiling in the range below that of middle distillate is removed from fractionation zone 12 via conduit 13 and recovered. A heavy hydrocarbon stream boiling in the range above that of middle distillate is removed from fractionation zone 12 via conduit 14 and recovered.

Figure 2:
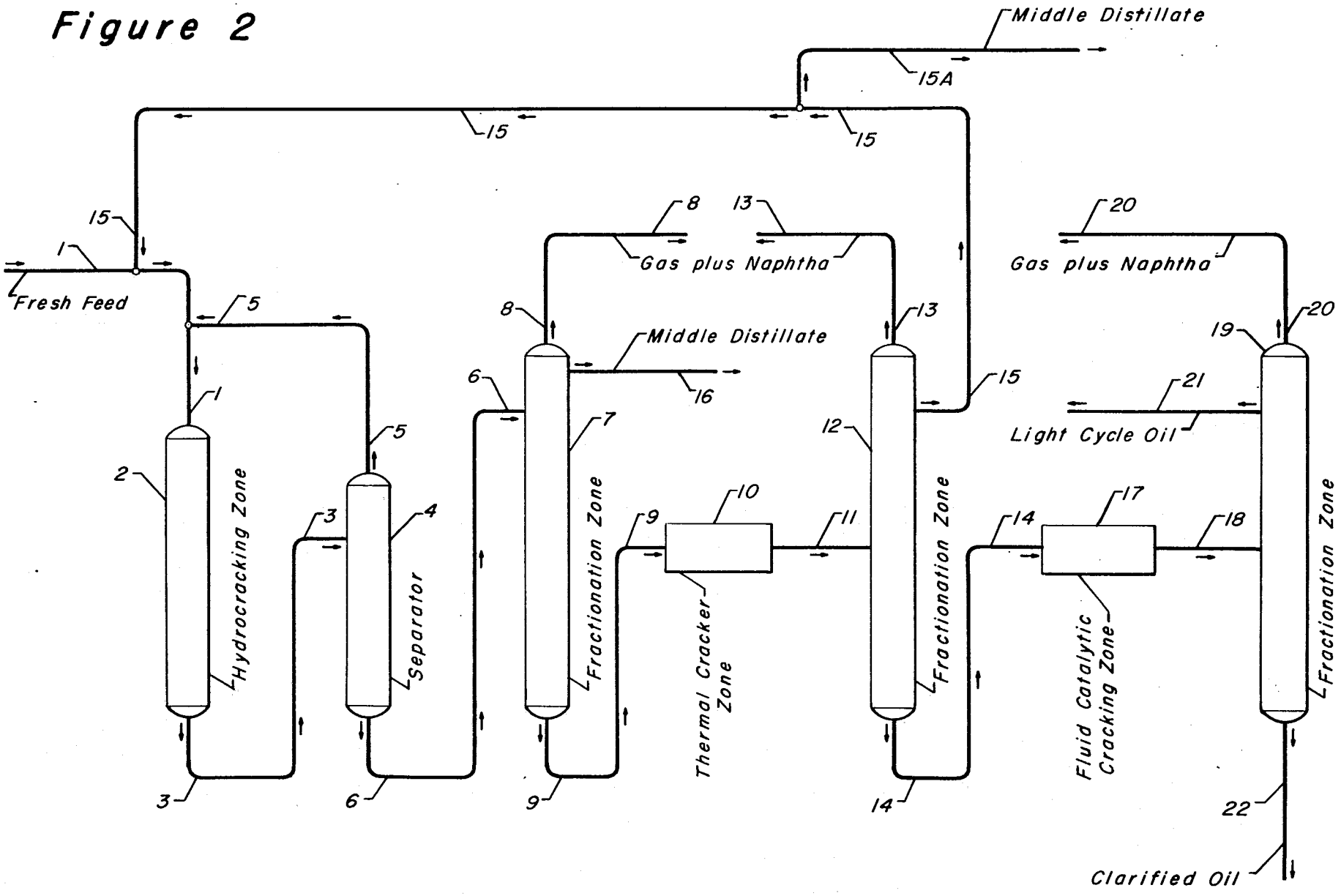

In FIG. 2, another embodiment of the subject invention is illustrated by means of a simplified flow diagram in which such details as pumps, instrumentation, heat-exchange and heat-recovery circuits, compressors and similar hardware have been deleted as being non-essential to an understanding of the techniques involved. With reference now to FIG. 2, an aromatic-rich distillable gas oil feedstock is introduced into the process via conduit 1, being admixed therein with a gaseous hydrogen-rich recycle stream which is provided via conduit 5 and a hereinafter described hydrocarbonaceous recycle stream provided via conduit 15. Following suitable heat-exchange, the admixture continues through conduit 1 into hydrocracking zone 2 which contains a fixed-bed of a catalytic composite of the type hereinabove described.

The principal function of hydrocracking zone 2 resides in the maximum production of middle distillate while minimizing the production of hydrocarbons boiling in the range below about 300° F. (149° C.) and in the conversion of aromatic hydrocarbon compounds contained in the charge stock to provide an increased concentration of paraffin hydrocarbon compounds. The peak temperature of the catalyst is adjusted to effect the desired yield pattern and aromatic hydrocarbon compound conversion. The effluent from hydrocracking zone 2 is cooled and passes via conduit 3 into separator 4. A hydrogen-rich gaseous stream is removed from separator 4 via conduit 5 and recycled to hydrocracking zone 2 via conduits 5 and 1. Since hydrogen is consumed within the hydrocracking process, it is necessary to supplant the consumed hydrogen with make-up hydrogen from some suitable external source, i.e., a catalytic reforming unit or a hydrogen plant. Make-up hydrogen may be introduced into the system at any suitable point. The normally liquid hydrocarbons are removed from separator 4 via conduit 6 and introduced into fractionation zone 7. A middle distillate hydrocarbonaceous product is removed from fractionation zone 7 via conduit 16 and a paraffin-rich hydrocarbonaceous stream boiling in a range above the middle distillate boiling range is removed from fractionation zone 7 via conduit 9. A light hydrocarbonaceous product stream boiling at a temperature less than about 350° F. (177° C.) is removed from fractionation zone 7 via conduit 8. The paraffin-rich hydrocarbonaceous stream boiling in a range above that of middle distillate is introduced via conduit 9 into thermal cracker zone 10, wherein the hydrocarbonaceous stream is subjected to thermal cracking conditions including an elevated temperature in the range of about 700° F. (371° C.) to about 980° F. (526° C.) and an equivalent residence time at 900° F. (482° C.) from about 1 to about 60 seconds. The thermal cracking product effluent is withdrawn from thermal cracker zone 10 via conduit 11 and introduced into fractionation zone 12. A hydrocarbonaceous stream boiling in the range from about 350° F. (177° C.) to about 700° F. (371° C.) is withdrawn from fractionation zone 12 via conduit 15 and at least a portion is introduced into hydrocracking zone 2 via conduits 15 and 1 as the hereinabove mentioned hydrocarbonaceous recycle stream. A hydrocarbonaceous product stream boiling in the range from about 350° F. (177° C.) to about 700° F. (371° C.) may also be produced in fractionation zone 12 and is recovered via conduits 15 and 15A. Such a product stream will necessarily be olefinic in nature and may require further processing. A light hydrocarbon stream boiling in the range below that of middle distillate is removed from fractionation zone 1 via conduit 13 and recovered. A heavy hydrocarbon stream boiling in the range above that of middle distillate is removed from fractionation zone 12 via conduit 14 and introduced into fluid catalytic cracking zone 17. The hydrocarbonaceous products produced therein are removed from fluid catalytic cracking zone 17 via conduit 18 and introduced into fractionation zone 19 which provides a light hydrocarbon stream, including naphtha, boiling in the range below that of middle distillate via conduit 20, a light cycle oil (LCO) stream boiling in the range of about 400° F. (204° C.) at about 650° F. (343° C.) via conduit 21 and a clarified oil stream boiling above that of light cycle oil via conduit 22.

The following examples are presented for the purpose of further illustrating the process of the present invention, and to indicate the benefits afforded by the utilization thereof in maximizing the yield of middle distillate from heavy distillate hydrocarbons.

EXAMPLE 1

An aromatic-rich, distillable feedstock having the characteristics presented in Table 1 was charged at a rate of 100 grams per hour to a hydrocracking reaction zone loaded with a catalyst comprising silica, alumina, nickel and molybdenum.

TABLE 1

| Feedstock Properties | |
|---|---|
| Boiling range, °F.(°C.) | 700(371)-986(529) |
| Gravity, °API(Specific) | 22.1(0.921) |
| Sulfur, weight % | 1.18 |
| Nitrogen, weight % | 0.39 |
| Carbon residue, weight % | 0.22 |
| Aniline pt, °F.(°C.) | 174(78) |
| UOP K | 11.75 |
| Aromatics, Volume % | 56 |

The reaction was performed with a catalyst peak temperature of 750° F. (399° C.), a pressure of 680 psig (4688k Pa gage), a liquid hourly space velocity of 0.67 based on fresh feed and a hydrogen circulation rate of 2500 SCFB (445 std $m^3/m^3$). The effluent from the hydrocracking zone was cooled to about 100° F. (38° C.) and sent to a vapor-liquid separator wherein a gaseous hydrogen-rich stream was separated from the normally liquid hydrocarbons. The resulting gaseous hydrogen-rich stream was then recycled to the hydrocracking zone together with a fresh supply of hydrogen in an amount sufficient to maintain the hydrocracking zone pressure. The normally liquid hydrocarbons were removed from the separator and charged to a fractionation zone. The fractionation zone produced a light hydrocarbon product stream boiling at a temperature less than 350° F. (177° C.) in an amount of 3.9 grams per hour, a middle distillate product stream in an amount of 19.8 grams per hour and having the properties presented in Table 2 and a heavy paraffin-rich hydrocarbonaceous stream boiling at a temperature greater than 700° F. (371° C.), having a UOP K of 11.97 and containing 45 volume precent aromatic hydrocarbons in an amount of 77.1 grams per hour. About 19.6 volume percent of the aromatic hydrocarbon compounds contained in the feedstock was converted to increase the concentration of paraffin hydrocarbon compounds.

TABLE 2

| Hydrocracker Middle Distillate Product Properties | |
|---|---|
| Boiling range, °F.(°C.) | 350(177)-700(371) |
| Gravity, °API(specific) | 32(0.865) |
| Cetane Number | 40 |

The resulting paraffin-rich heavy hydrocarbonaceous stream was then charged to a thermal cracker zone maintained at a pressure of about 300 psig (2068k Pa gage) and the temperature of about 925° F. (496° C.).

The effluent from the thermal cracker zone was introduced into a second fractionation zone which produced a light hydrocarbon product stream boiling at a temperature less than 350° F. (177° C.) in an amount of 4.3 grams per hour, a middle distillate hydrocarbon stream boiling in the range from about 350° F. (177° C.) to about 700° F. (371° C.) in an amount of 24.1 grams per hour and a gas oil product in the amount of 48.7 grams per hour and having the properties presented in Table 3. The product properties of the middle distillate hydrocarbon stream recovered from the thermal cracking zone effluent are presented in Table 4 and were approximately the same as those for the middle distillate recovered from the hydrocracking zone and presented in Table 2 with the exception that the thermal cracker middle distillate was olefinic, as indicated by the bromine number, as a result of the thermal cracking processing. In some cases, this olefinic characteristic may be somewhat undesirable for certain applications and therefore it may be desirable to hydrogenate the resulting thermal cracker middle distillate in order to reduce the level of olefinicity

TABLE 3

| Thermal Cracker Gas Oil Product Properties | |
|---|---|
| Boiling range, °F.(°C.) | 700+(371+) |
| Gravity, °API(Specific) | 23(0.915) |
| Sulfur, weight % | 0.13 |
| Nitrogen, weight % | 0.29 |
| Carbon residue, weight % | 0.42 |
| Aniline Pt, °F.(°C.) | 192(89) |
| UOP K | 11.90 |

TABLE 4

| Thermal Cracker Middle Distillate Product Properties | |
|---|---|
| Boiling range, °F.(°C.) | 350(177)-700(371) |
| Gravity, °API(Specific) | 29.5(0.879) |
| Bromine Number | 20 |
| Cetane Number | 45 |

In summary, one embodiment of the process of the present invention produced the following products based on the weight of the fresh feed distillate: light hydrocarbons boiling below about 350° F. (177° C.), 8.2 weight percent; middle distillate product (from hydrocracker and thermal cracker) having a boiling range from about 350° F. (177° C.) to about 700° F. (371° C.), 43.9 weight percent and gas oil product, 48.7 weight percent. In addition, it should be noted by a comparison of Tables 1 and 3 that the thermal cracker gas oil product possessed superior physical characteristics in contrast with the original feed stock. In accordance with the objective of the present invention, an outstanding amount of middle distillate, 43.9 weight percent based on fresh feed, was surprisingly and unexpectedly produced while simultaneously producing a heavy distillate thermal cracker gas oil which was a premium potential feedstock compared with the original feedstock.

EXAMPLE 2

In this Example all of the middle distillate is recovered from the effluent of the hydrocracking zone. An aromatic-rich, distillable feedstock having the characteristics presented in Table 1 hereinabove was charged at a rate of 100 g/hr to a hydrocracking reaction zone loaded with the catalyst of Example 1 comprising silica, alumina, nickel and molybdenum. The reaction was performed with a catalyst peak temperature of 750° F. (399° C.), a pressure of 680 psig (4688k Pa gage), a liquid hourly space velocity of 0.67 based on fresh feed and a hydrogen circulation rate of 2500 SCFB (444 std $m^3/m^3$). In addition, a recycle stream, more fully described hereinbelow, was charged to the hydrocracking zone at a rate of 24.1 g/hr. The effluent from the hydrocracking zone was cooled to about 100° F. (38° C.) and sent to a vapor-liquid separator wherein a gaseous hydrogen-rich stream was separated from the normally liquid hydrocarbons. The resulting gaseous hydrogen-rich stream was then recycled to the hydrocracking zone together with a fresh supply of hydrogen in an amount sufficient to maintain the hydrocracking zone pressure. The normally liquid hydrocarbons were removed from the separator and charged to a fractionation zone. The fractionation zone produced a light hydrocarbon product stream boiling at a temperature less than 350° F. (177° C.) in an amount of 3.9 g/hr, a middle distillate product stream in an amount of 43.9 g/hr and having the properties presented in Table 5 and a paraffin-rich, heavy hydrocarbonaceous stream boiling at a temperature greater than 700° F. (371° C.), having a UOP K of 11.97 and containing 45 volume percent aromatic hydrocarbons in an amount of 77.1 g/hr. About 19.6 volume percent of the aromatic hydrocarbon compounds contained in the feedstock was converted to increase the concentration of paraffin hydrocarbon compounds.

For purposes of comparision, the blended composite of hydrocracker and thermal cracker middle distillate product from Example 1 was analyzed and was found to have the properties presented in Table 5.

TABLE 5

| Middle Distillate Product Properties | | |
|---|---|---|
| | Example 2 | Example 1 Blend |
| Boiling range, °F.(°C.) | 350(177)–700(371) | 350(177)–700(371) |
| Gravity, °API(Specific) | 32(0.865) | 31(0.871) |
| Cetane Number | 44 | 43 |
| Bromine Number | 2 | 12 |

The resulting paraffin-rich heavy hydrocarbonaceous stream was then charged to a thermal cracker zone maintained at a pressure of about 300 psig (2068k Pa gage) and a temperature of about 925° F. (495° C.).

The effluent from the thermal cracker zone was introduced into a second fractionation zone which produced a light hydrocarbon product stream boiling at a temperature less than 350° F. (177° C.) in an amount of 4.3 g/hr, a middle distillate hydrocarbon stream boiling in the range from about 350° F. (177° C.) to about 700° F. (371° C.) which is recycled to the hydrocracking zone in an amount of 24.1 g/hr and a gas oil product in the amount of 48.7 g/hr and having the properties presented in Table 3 hereinabove.

In summary, one embodiment of the present invention produced the following products based on the weight of the fresh feed distillate: light hydrocarbons boiling below about 350° F. (177° C.), 8.2 weight percent; middle distillate product having a boiling range from about 350° F. (177° C.) to about 700° F. (371° C.), 43.9 weight percent and gas oil product, 48.7 weight percent. In addition, it should be noted by a comparison of Tables 1 and 3 that the thermal cracker gas oil product possesses superior physical characteristics in contrast with the feedstock such as, for example, the thermal cracker gas oil product has a lower specific gravity, a lower sulfur and nitrogen content and a higher concentration of paraffin compounds as indicated by the UOP K. The utilization of this embodiment of the present invention produced 43.9 weight percent middle distillate, based on fresh feed, and as a result of recycling the thermal cracker middle distillate to the hydrocracker zone, the quality of the overall middle distillate product in terms of bromine number and cetane number was improved while not significantly effecting the specific gravity. This improvement is demonstrated by the comparison of middle distillate product properties presented in Table 5.

EXAMPLE 3

In another embodiment of the present invention, 48.7 grams/hour of thermal cracker gas oil produced in Example 1 and having the properties described hereinabove in Table 3 was charged to a fluid catalytic cracking zone. As shown before, the quantity and quality of thermal cracker gas oil product produced in Examples 1 and 2 hereinabove are identical. The fluid catalytic cracking of the gas oil was conducted at cracking conditions which included a zeolitic catalyst, a pressure of about 0 psig (101k Pa gage), a reactor temperature of 950° F. (510° C.) and a catalyst to oil ratio of 6:1. The effluent from the fluid catalytic cracking zone was fractionated to produce 26.4 grams/hour of gasoline, 5.4 grams/hour of light cycle oil and 4.8 grams/hour of clarified oil. For purposes of comparison, in another run with the same fluid catalytic cracking zone and operating conditions as used and described hereinbefore, 48.7 grams/hour of the virgin distillate feedstock having the properties described in Table 1 was charged to the fluid catalytic cracking zone. The effluent from the fluid catalytic cracking zone was fractionated to produce 24.7 grams/hour of gasoline, 6.9 grams/hour of light cycle oil and 5.2 grams/hour of clarified oil. The following Table 6 summarizes the operation and results of the fluid catalytic cracking zone with both hereinabove described feedstocks.

TABLE 6

| Fluid Catalytic Cracking Summary | | |
|---|---|---|
| | Thermal Cracker Gas Oil Feed | Table 1 Feed |
| Pressure, psig(k Pa gage) | 0(101) | 0(101) |
| Reactor temperature, °F.(°C.) | 950(510) | 950(510) |
| Catalyst/Oil ratio | 6 | 6 |
| Gasoline yield, volume percent | 65.6 | 62.2 |
| Research octane number, clear | 92 | 92 |
| Conversion, volume percent | 81.9 | 78.1 |
| Coke yield, weight percent | 6.7 | 7.2 |

This example demonstrates that a thermal cracker gas oil derived from a preferred embodiment of the present invention is not only a suitable feedstock for a catalytic cracking zone and yields gasoline in excellent quantity and quality as shown in Table 6, but in substantially all respects demonstrates better results than those achieved from the virgin distillate feedstock used to ultimately derive the thermal cracker gas oil.

EXAMPLE 4

This example demonstrates the yields which may be expected from a fully integrated process which is one embodiment of the present invention. These expected yields are based on the data generated in the hereinabove presented examples. The subject integrated process utilizes a hydrocracking zone, a thermal cracking zone and a fluid catalytic cracking zone. In the event a feedstock described hereinabove in Table 1 is processed in the subject integrated process at a rate of 10,000 barrels per day (BPD) (66.2 $m^3$/hr.), the resulting products include 4,630 BPD (30.7 $m^3$/hr.) of diesel, 3,220 BPD (21.3 $m^3$/hr.) of gasoline, 490 BPD (3.2 $m^3$/hr.) of light cycle oil and 400 BPD (2.6 $m^3$/hr.) of clarified oil. For purposes of comparison, the same fluid catalytic cracking zone operating at comparable conditions with a feed of 10,000 barrels per day (66.2 $m^3$/hr.) of the feedstock, virgin gas oil, described in Table 1 produces 6220 BPD (41.2 $m^3$/hr.) of gasoline, 1300 BPD (8.6 $m^3$/hr.) of light cycle oil and 890 BPD (5.9 $m^3$/hr.) of clarified oil. A summary of these results are presented in Table 7.

TABLE 7

| Summary of Results | | |
|---|---|---|
| | Integrated Process | Fluid Catalytic Cracking Alone |
| Feed, BPD($m^3$/hr.) | 10,000(66.2) | 10,000(66.2) |
| Products, BPD($m^3$/hr.) | | |
| Diesel | 4,630(30.7) | 0 |
| Gasoline | 3,220(21.3) | 6,220(41.2) |
| Light Cycle Oil | 490(3.2) | 1,300(8.6) |
| Clarified Oil | 400(2.6) | 890(5.9) |

This example demonstrates that in accordance with the present invention a high yield of diesel product, over 46 volume percent of the fresh feed, is realized while simultaneously producing gasoline, light cycle oil and clarified oil.

The present invention is further demonstrated by the following illustrative embodiment. This illustrative embodiment is however not presented to unduly limit this invention, but to further illustrate the advantages of the hereinabove described embodiment. The following data were not obtained by the actual performance of the present invention but are considered prospective and reasonably illustrative of the expected performance of the invention.

ILLUSTRATIVE EMBODIMENT

In this illustrative embodiment, three separate flow schemes are compared in order to demonstrate the advantages of the present invention.

In the first flow scheme of Case 1, an aromatic-rich, distillate feedstock derived from a heavy Arabian crude having the characteristics presented in Table 6 is charged at a rate of 20,000 barrels per day (132.5 $m^3$/hr.) to a hydrocracking reaction zone operating at approximately 30 volume percent conversion of the feedstock boiling at a temperature greater than 700° F. (371° C.) and a pressure of 900 psig (6205k Pa gage).

TABLE 6

| Feedstock Properties | |
|---|---|
| Boiling range, °F.(°C.) | 600(315)-1050(565) |
| Gravity, °API(Specific) | 21.5(0.924) |
| Sulfur, weight percent | 2.24 |
| Aromatics, weight percent | 56 |
| Paraffins and Naphthenes, weight percent | 44 |

The effluent from the hydrocracking reaction zone contains 6,769 barrels per day (44.8 $m^3$/hr.) of 350° F. (177° C.)-700° F. (371° C.) middle distillate, 409 barrels per day (2.7 $m^3$/hr.) of $C_5$—350° F. (177° C.) naphtha and 13,243 barrels per day (87.7 $m^3$/hr.) of 700° F. (371° C.) plus heavy oil. The resulting heavy oil is charged to a fluid catalytic cracker which yields 8634 barrels per day (57.2 $m^3$/hr.) of gasoline, 1382 barrels per day (9.1 $m^3$/hr.) of light cycle oil (LCO) and 959 barrels per day (6.35 $m^3$/hr.) of slurry. The combined yields and product qualities for Case 1 are presented in Table 7.

In the second flow scheme or Case 2 which is one embodiment of the present invention, the 13,243 barrels per day (87.7 $m^3$/hr.) of 700° F. (371° C.) plus heavy oil from Case 1 is charged to a thermal cracker where there is approximately an additional 25 weight percent conversion of 700° F. (371° C.) plus heavy oil. The combined effluent from the hydrocracker and thermal cracker consists of 11,142 barrels per day (73.8 $m^3$/hr.) of 350° F. (177° C.)-700° F. (371° C.) middle distillate, 1,167 barrels per day (7.73 $m^3$/hr.) of $C_5$—350° F. (177° C.) naphtha and 8249 barrels per day (54.6 $m^3$/hr.) of 700° F. (371° C.) plus heavy oil. The resulting heavy oil is charged to a fluid catalytic cracker which yields 5112 barrels per day (33.9 $m^3$/hr.) of gasoline, 948 barrels per day (6.28 $m^3$/hr.) of light cycle oil (LCO) and 844 barrels per day (5.59 $m^3$/hr.) of slurry. The combined yields and product qualities for Case 2 are also presented in Table 7.

In the third flow scheme or Case 3, the feedstock described in Table 6 is charged at a rate of 20,000 barrels per day (132.5 $m^3$/hr.) to a hydrocracking unit operated at 1400 psig (9653k Pa gage) and a fluid catalytic cracker in a manner such that the combined yield of 350° F. (177° C.)-700° F. (371° C.) middle distillate is equal to that produced in Case 2. The hydrocracking unit is operated at approximately 60 volume percent conversion such that the effluent consists of 11,364 barrels per day (75.3 $m^3$/hr.) of 350° F. (177° C.)-700° F. (371° C.) middle distillate, 2123 barrels per day of $C_5$—350° F. (177° C.) naphtha and 7541 barrels per day (49.9 $m^3$/hr.) of 700° F. (371° C.) plus heavy oil. The resulting heavy oil is charged to a fluid catalytic cracker which yields 5033 barrels per day (33.3 $m^3$/hr.) of gasoline, 725 barrels per day (4.8 $m^3$/hr.) of light cycle oil (LCO) and 361 barrels per day (2.4 $m^3$/hr.) of slurry.

The combined yields and product qualities for Case 3 are also presented in Table 7.

TABLE 7

| Case Study Yields and Product Qualities | | | |
|---|---|---|---|
| | Case 1 | Case 2 | Case 3 |
| Naphtha, BPD($m^3$/hr.) | 409(2.7) | 1167(7.73) | 2123(14.1) |
| FCC Gasoline, BPD($m^3$/hr.) | 8634(57.2) | 5112(33.9) | 5033(33.3) |
| Research Octane Number | 92 | 92 | 92 |
| Total, BPD($m^3$/hr.) | 9043(59.9) | 6279(41.6) | 7156(47.4) |
| Diesel + LCO, BPD($m^3$/hr.) | 8151(54.0) | 12090(80.1) | 12090(80.1) |
| Cetane Index | 37.2 | 42.4 | 45.5 |
| Hydrogen Consumption, SCFB(Std. $m^3/m^3$) | 537(95.4) | 537(95.4) | 1009(179.4) |

A comparison of the product yields and qualities in Table 7 demonstrates that Case 2 which is one embodiment of the present invention shows a higher yield of diesel plus LCO with an improved quality compared with Case 1 while the quality of the FCC gasoline for both cases is equivalent.

Another comparison of the product yields and qualities in Table 7 demonstrates that Case 2 provides an equivalent yield of diesel plus LCO compared with Case 3 but with only approximately one-half the hydrogen consumption. The quality of the FCC gasoline for both Cases 2 and 3 is equivalent.

The foregoing description, drawings, examples and illustrative embodiment clearly illustrate the advantages encompassed by the process of the present invention and the benefits to be afforded with the use thereof.

We claim as our invention:

1. A process for the conversion of an aromatic-rich, distillable gas oil charge stock which is essentially free from asphaltenic hydrocarbons and possesses an aromatic hydrocarbon concentration greater than about 20 volume percent to selectively produce large quantities of high quality middle distillate while minimizing hydrogen consumption consisting essentially of the steps of:

(a) reacting said charge stock with hydrogen, in a catalytic hydrocracking reaction zone, at hydrocracking conditions including a maximum catalyst bed temperature in the range of about 600° F. (315° C.) to about 850° F. (454° C.) selected to convert at least a portion of said charge stock to lower-boiling hydrocarbon products including middle distillate and to convert at least about 10 volume percent of the aromatic hydrocarbon compounds contained in said charge stock to provide an increased concentration of paraffin hydrocarbon compounds in the resulting hydrocracking reaction zone effluent;

(b) separating said resulting hydrocracking reaction zone effluent to provide a middle distillate product stream and a paraffin-rich hydrocarbonaceous stream boiling at a temperature greater than about 700° F. (371° C.);

(c) recovering said middle distillate product stream;

(d) reacting said paraffin-rich hydrocarbonaceous stream recovered in step (b) in a non-catalytic thermal reaction zone at mild thermal cracking conditions including an elevated temperature from about 700° F. (371° C.) to about 980° F. (526° C.), a pressure from about 30 psig (207k Pa gage) to about 1000 psig (6895k Pa gage) and an equivalent residence time at 900° F. (482° C.) from about 1 to about 60 seconds to provide a non-catalytic thermal reaction zone effluent;

(e) separating said non-catalytic thermal reaction zone effluent to provide a fraction boiling in the range from about 300° F. (149° C.) to about 700° F. (371° C.) and a hydrocarbonaceous stream boiling at a temperature greater than about 700° F. (371° C.); and (f) reacting at least a portion of said hydrocarbonaceous stream boiling at a temperature greater than about 700° F. (371° C.) recovered in step (e) in a fluid catalytic cracking zone at fluid catalytic cracking conditions.

2. The process of claim 1 wherein at least a portion of said fraction boiling in the range from about 300° F. (149° C.) to about 700° F. (371° C.) provided in step (e) is recycled to said catalytic hydrocracking reaction zone of step (a).

3. The process of claim 1 wherein said aromatic-rich, distillable gas oil charge stock boils in the range from about 700° F. (371° C.) to about 1050° F. (565° C.).

4. The process of claim 1 wherein said aromatic-rich, distillable gas oil charge stock possesses a UOP Characterization Factor less than about 12.4.

5. The process of claim 1 wherein said hydrocracking conditions include a pressure from about 500 psig (3447k Pa gage) to about 3000 psig (20685k Pa gage).

6. The process of claim 1 wherein said hydrocracking conditions include a pressure from about 600 psig (4137k Pa gage) to about 1600 psig (11032k Pa gage).

7. The process of claim 1 wherein said hydrocracking conditions include a liquid hourly space velocity from about 0.2 to about 10.0 $hr.^{-1}$ based on fresh feed.

8. The process of claim 1 wherein said hydrocracking conditions include a hydrogen circulation rate of about 500 SCFB (88.9 std. $m^3/m^3$) to about 10,000 SCFB (1778 std. $m^3/m^3$).

9. The process of claim 1 wherein said catalytic hydrocracking reaction zone is operated at conditions selected to convert less than about 50 volume percent of said charge stock to lower-boiling hydrocarbon products.

10. The process of claim 1 wherein said thermal cracking conditions include a pressure from about 30 psig (207k Pa gage to about 500 psig (3447k Pa gage).

11. The process of claim 1 wherein said catalytic hydrocracking reaction zone contains a catalyst comprising a refractory inorganic oxide and at least one metal component selected from the group consisting of Groups VIB and VIII.

12. The process of claim 1 wherein said catalytic hydrocracking reaction zone contains a catalyst comprising silica, alumina, nickel and molybdenum.

13. The process of claim 1 wherein said fluid catalytic cracking conditions include a reactor temperature from about 900° F. (482° C.) to about 1350° F. (734° C.), a pressure from about 0 psig (101k Pa gage) to 200 psig (1379k Pa gage) and a catalyst to oil ratio, based on the weight of catalyst and feed hydrocarbon, of up to about 50:1.

14. The process of claim 1 wherein said fluid catalytic cracking zone contains an amorphous catalyst.

15. The process of claim 1 wherein said fluid catalytic cracking zone contains a zeolitic catalyst.

* * * * *